US008313313B2

(12) United States Patent
Jüterbock et al.

(10) Patent No.: US 8,313,313 B2
(45) Date of Patent: Nov. 20, 2012

(54) PUMPING DEVICE

(75) Inventors: Karsten Jüterbock, Wangen (DE); Daniele Foffano, Vimercate (IT); Angelo Basso, Trezzo sull'Adda (IT); Davide Galvani, Medicina (IT)

(73) Assignee: J. Wagner AG (CH)

( * ) Notice: Subject to any disclaimer, the term of this patent is extended or adjusted under 35 U.S.C. 154(b) by 877 days.

(21) Appl. No.: 12/319,829

(22) Filed: Jan. 13, 2009

(65) Prior Publication Data

US 2009/0196771 A1 Aug. 6, 2009

(30) Foreign Application Priority Data

Jan. 31, 2008 (EP) ..... 08001762

(51) Int. Cl.
*F04B 45/00* (2006.01)
*F04B 17/00* (2006.01)

(52) U.S. Cl. ..... 417/399; 417/395

(58) Field of Classification Search ..... 417/395, 417/399

See application file for complete search history.

(56) References Cited

U.S. PATENT DOCUMENTS

| | | | | |
|---|---|---|---|---|
| 4,008,984 | A | 2/1977 | Scholle | |
| 5,667,368 | A * | 9/1997 | Augustyn et al. | 417/385 |
| 6,158,982 | A | 12/2000 | Kennedy et al. | |
| 2004/0083883 | A1 | 5/2004 | Bubb et al. | |
| 2006/0257271 | A1 | 11/2006 | Juterbock et al. | |

FOREIGN PATENT DOCUMENTS

| | | |
|---|---|---|
| DE | 31 46 222 | 6/1983 |
| DE | 40 27 027 | 3/1992 |

* cited by examiner

*Primary Examiner* — Anh T. Mai
*Assistant Examiner* — Zachary J Snyder
(74) *Attorney, Agent, or Firm* — Pandiscio & Pandiscio

(57) ABSTRACT

A pumping device (1) by which fluids held in a reservoir tank (9) can be pumped to a spray gun (11) in a metered manner, with a piston rod (5) mounted in a housing (2) in axially movable fashion, with a reciprocating piston (25) attached thereto, with a piston (7, 8) connected to the piston rod (5) and moved between a first and a second housing sections (3, 4), first and second pressure spaces (21,21', 22, 22') enclosed with the two housing sections (3,4), two pressure lines (17, 17') in each of the housing sections (3, 4) such that emerge into one of the pressure spaces (21, 21' or 22,22'), a working medium (19) pressed through pressure lines (17, 17') alternately into a pressure space, by means of which the piston (7, 8) is driven, with a diaphragm a central area (14) connected to the piston rod (5), and its outer area (15) connected to the housing (2), and a flexible ring area (16) between the central and outer areas (14, 15), and a pumping space (20) enclosed by the diaphragm (12, 13) and the housing (2), into which the fluid is alternately sucked in or pressed out towards the spray gun (11) by the axial movement of the piston (25), to determine the sealing status of the diaphragm (12, 13) so as to prevent contamination passing between the fluid (10) and hydraulic oil (19), a control space (31) formed between a housing section (3) and a diaphragm (12,13), and can be monitored.

9 Claims, 3 Drawing Sheets

PUMPING DEVICE

BACKGROUND OF THE INVENTION

1. Field of the Invention

The present invention relates to a pumping device by means of which fluids or free flowing material held in a reservoir tank can be pumped to a spray gun in a metered manner.

2. Description of the Prior Art

A pumping device of this type, which is configured as a double-diaphragm piston pump, is disclosed in EP 1712796 A1. This diaphragm piston pump consists of a piston rod with a diaphragm firmly attached to each of the free ends of the piston rod. The outer area of the particular diaphragm is clamped in a housing of the pumping device, with the effect that there is a flexible ring area between the firmly clamped area and the central area of the diaphragm locked against the piston rod, in which case the flexible ring area compensates the axial movements of the piston rod in relation to the housing.

A reciprocating piston is mounted on both free ends of the piston rod, by means of which the fluid or the free flowing material is sucked out of the reservoir tank into a pumping space enclosed by the diaphragm and the housing, and then pressed out of this pumping space in a metered manner to a spray gun. The two reciprocating pistons alternately suck in and press out the fluid or the material, which means the resulting flow of fluid or free flowing material is almost constant because one reciprocating piston is sucking in the fluid or the material whilst the other reciprocating piston is pressing it out.

In order to drive the piston rod reliably, a piston is firmly connected to the piston rod between the two diaphragms. The distance between the piston and the particular diaphragm is of equal magnitude in this case. The piston, together with a first and a second housing section, closes a pressure space into which compressed air is admitted alternately through a valve, with the effect that the piston can be moved back and forth between two dead points that are chiefly formed by the first and the second housing sections.

The pumping device disclosed in EP 1712796 A1 has proven effective in practice, because the special configuration of the diaphragm makes it possible to achieve a long service life.

However, during operation of the pumping device, there is a danger that hairline cracks or other damage may come about in the diaphragm due to the permanent loadings attributable to the pumping oscillations, and that these hairline cracks or other damage may allow the fluid or free flowing material that is to be pumped to mix with the fluid guiding the diaphragm, e.g. hydraulic oil. This means that either the hydraulic oil penetrates the pumping space through the diaphragm or that, if the damage to the diaphragm structure is considerable, the fluid or material to be pumped penetrates the space for the hydraulic fluid.

This effect gives rise to significant damage within the hydraulic oil circuit, because the mixing of the fluid or free flowing material with hydraulic oil gives rise to a substance that hardens, resulting in the blockage of the pressure lines in the hydraulic oil circuit. Cleaning the hydraulic oil circuit or the pumping space is extremely time-consuming; frequently, the pumping device is rendered completely unusable by these impurities and must be renewed. However, this gives rise to considerable downtimes which must be avoided whilst the pumping device is in operation.

SUMMARY OF THE INVENTION

The task of the present invention is therefore to develop a pumping device of the aforementioned type in such a way that the sealing status of the diaphragm used in the pumping device can be reliably established on a permanent basis, or at least from time to time, in order to allow the pumping device to be shut down in good time if necessary in case of damage to the diaphragm, so that contamination or impurities can be prevented from passing between the fluid or material and the hydraulic oil.

Furthermore, the flexibly configured ring area of the diaphragm should be held out of the pumping space and not snap into it.

In accordance with the present invention a control space with negative pressure is provided within the housing of the pumping device immediately adjacent to the diaphragm, which guarantees that the sealing status of the diaphragm can be monitored in the area of the ring area that moves back and forth, because if the diaphragm has hairline cracks or other damage then the pressure in the control space is equalized and this effect is detected by the measuring instrument. A rise in the pressure level within the control space namely implies that the diaphragm is leaking and that there is a danger that the fluid or material to be pumped could pass through the porous and damaged diaphragm into the control space. The damage to the diaphragm can advance gradually, therefore even the smallest pressure fluctuations should be picked up so that mixing between the fluid to be pumped and the working medium can be prevented.

The negative pressure in the control space furthermore serves to suck the flexible ring area of the diaphragm into the control space and hold it in this area, in order to prevent the ring area snapping over into the pumping space. In addition, it is especially advantageous if the pumping flow of the fluid or the material can be adjusted independently from the flow of the working medium for driving the piston, because the control space is arranged between the pumping and pressure spaces of the drive pistons, and that these are consequently spatially separated from one another. This spatial separation increases the operating security of the pumping device in an advantageous manner, because the control space allows leaking fluid or material to be collected without getting into the pressure space.

BRIEF DESCRIPTION OF THE DRAWINGS

The drawings show a pumping device configured in accordance with the present invention, the details of which are explained below. In the drawings.

DESCRIPTION OF THE PREFERRED EMBODIMENTS

Figure 1:
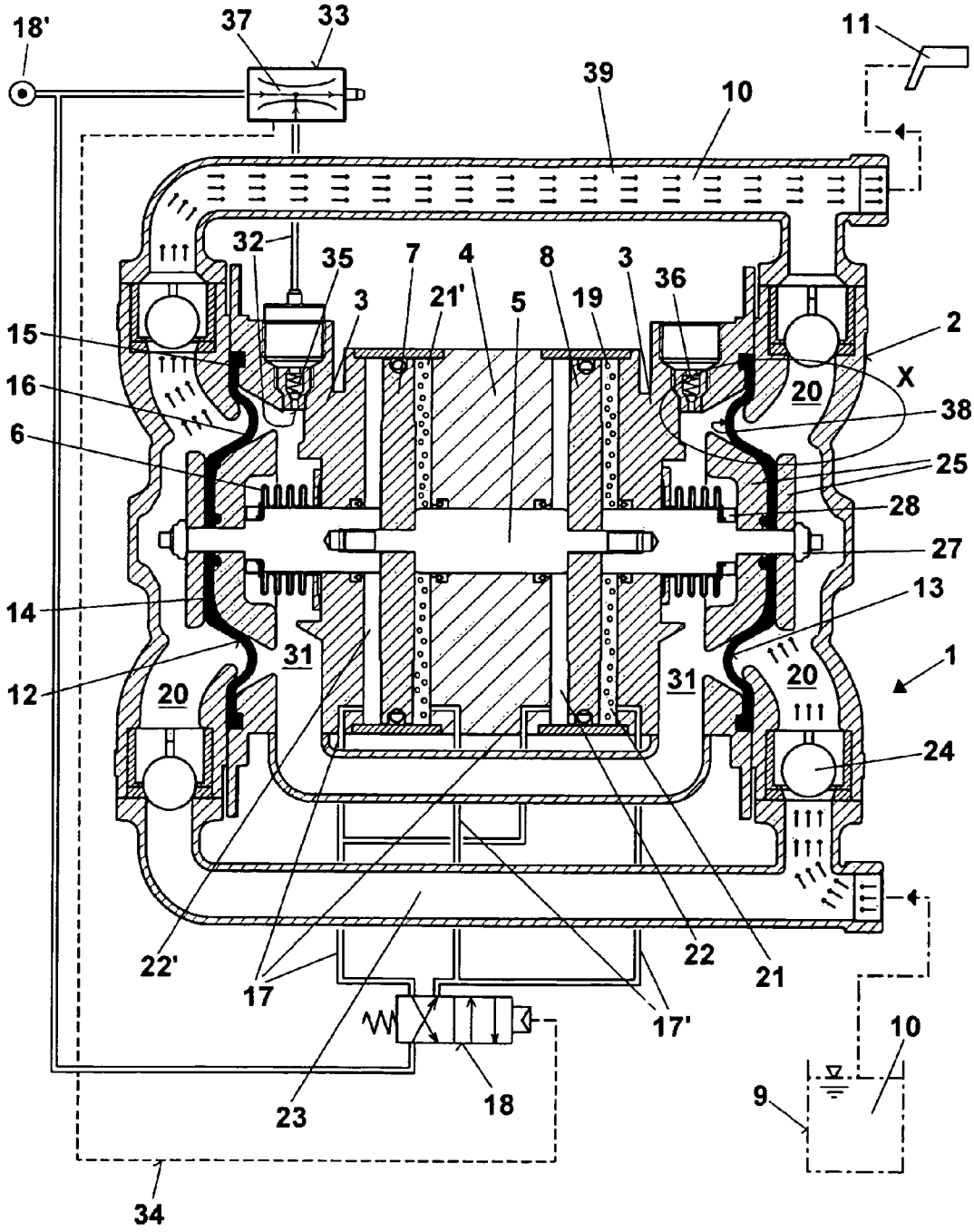
FIG. 1 shows a first operating position of the pumping device equipped with two pistons firmly attached to a piston rod, reciprocating pistons and diaphragms, by means of which a fluid can be pumped from a reservoir tank to a spray gun in a metered manner.

FIG. 1 shows a pumping device 1 by means of which a fluid 10 held in a reservoir tank 9 can be metered or pumped to a spray gun 11 or to an outlet pump. The spray gun 11 is normally configured as a device for manual work which the user operates by hand in order to apply the fluid 10, for example paints, varnishes, emulsions, solvents, coating material, or the like, onto a surface. The adjustable pumping speed or the pumping device 1 allows the flow rate of the fluid 10 to be controlled in this case.

The pumping device can, however, also be used for pumping materials from a low pressure level to a higher level, for example in order to allow materials to be transported in pipelines over relatively long distances.

In order for the fluid 10 to be pumped out of the reservoir tank 9 to the spray gun 11, the pumping device 1 consists of a housing 2 that is divided into two housing sections 3 and 4 in its central area. The housing 2 holds a piston rod 5 in an axially movable manner; the piston rod 5 therefore moves back and forth between two dead points that are formed by the housing sections 3 and 4.

Two pistons 7 and 8 are attached to the piston rod 5 at a distance from one another and in parallel to one another, in order to drive the piston rod 5. The outer housing section 3, together with the particular piston 7 or 8, forms a pressure space 21. The housing section 4 in conjunction with the corresponding piston 7 or 8 encloses a further pressure space 22 or 22'. A pressure line 17 or 17' emerges into each of the pressure spaces 21, 21' and 22, 22' thereby formed and each pressure line 17 or 17' is connected to a changeover valve 18. A working medium 19, for example hydraulic oil, a gaseous substance or a gas/fluid mixture, is pressed into the pressure space 21 and 21' or 22 and 22' alternately via the changeover valve 18. The two end faces of pistons 7 and 8 are therefore alternately exposed to a pressure force, which therefore acts on pistons 7 and 8, and by means of which the piston rod 5 can be moved between the two dead points enclosed and prescribed by the housing sections 3 and 4.

In the outer area of the housing 2, there is a pumping line 23 or 39, the input end of which emerges in the reservoir tank 9 and communicates with it, and the output end of which is connected to the spray gun 11. Two reciprocating pistons 25 are attached at the two free ends of the piston rod 5 for pumping the fluid 10 out of the reservoir tank 9 to the spray gun 11. The two-piece configurations of the reciprocating piston 25 means that one diaphragm 12 or 13 each is held in position. A nut 27 screwed into the piston rod 5 clamps the reciprocating piston onto this, so that the diaphragm 12 or 13 is fixed in position.

The diaphragms 12 and 13 are divided into three areas, namely into a central area 14 that is firmly connected to the piston rod with the effect that the axial movements initiated by the piston rod 5 are transferred to the diaphragm 12 or 13, into an outer area 15 that is clamped firmly in the housing 2 and into a flexible ring area 16 arranged between the central area 14 and the outer area 15, by means of which the axial movements of the piston rod 5 can be compensated.

The pumping line 23 emerges into a pumping space 20 that is enclosed by the housing 2 and the particular diaphragm 12 or 13. The operating position of the pumping device 1 shown in FIG. 1 corresponds to a middle position. The diaphragm 13 is moved away from the pumping space 20, with the effect that a negative pressure is created in the pumping space 20, by means of which the fluid 10 held in the reservoir tank 9 is sucked out of it into the pumping space 20 assigned to the diaphragm 13. At the same time, the reciprocating piston 25 and the flexible ring area 16 of the diaphragm 12 act on the fluid 10 present in the pumping space 20 that is assigned to this diaphragm 12 in such a way that a positive pressure results in the pumping space 20 which causes the fluid 10 sucked into it to be pressed out through the pumping line 39 to the spray gun 11. Each of the transitional areas between the pumping line 39 and the two pumping spaces 20 is sealed with a non-return valve 24 in order to ensure that the pumping device functions reliably, i.e. the working medium 19 is to be prevented from flowing back.

Figure 2:
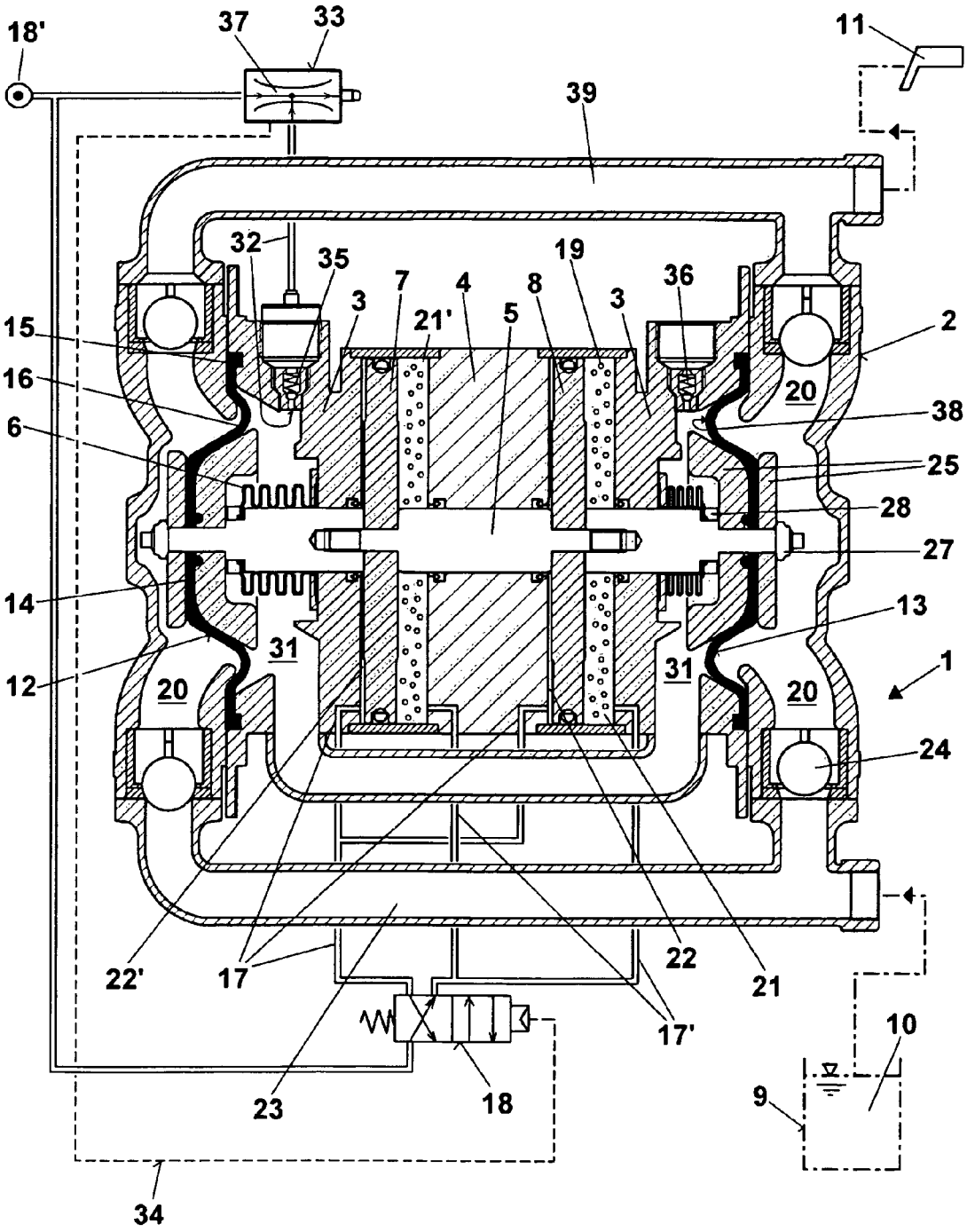
FIG. 2 shows the pumping device in accordance with FIG. 1 in a second operating position.

FIG. 2 shows the pumping device 1 in a second operating position. In this case, the diaphragm 12 is located at its upper dead position. The fluid 10 sucked into the pumping space 20 assigned to the diaphragm 12 has been completely pressed out of this space into the pumping line 39 on the output end, and the pumping space 20 assigned to the diaphragm 13 is completely filled with fluid 10. The working medium 19 is now pressed into the pressure spaces 22 and 22' via the changeover valve 18; the working medium 19 existing in the pressure spaces 21 and 21' is pressed out of them through the pressure lines 17', with the effect that both pistons 7 and 8 and the piston rod 5 connected to them are moved from the upper dead point to the lower dead point, and that the fluid 10 filled into the pumping space 20, which is assigned to the diaphragm 13, is pumped out of this space to the spray gun 11.

The pumping device 1 configured as a double-diaphragm piston pump accordingly generates an almost continuous flow of the fluid 10. However, it is also feasible without further complexity for the pumping device 1 only to be equipped with one diaphragm 12 and for the fluid 10 to be pumped from the reservoir tank 9 to the spray gun 11 in pulses.

It is also feasible for only one of the two pistons 7 or 8 to be attached to the piston rod 5, or for a plurality of pistons 7 and 8 to be fixed onto the piston rod 5, by means of which a plurality of pressure spaces 21 and 22 is enclosed in conjunction with the housing sections 3 and 4.

When pumping devices 1 of this kind are used, it has been established that the oscillation and the associated loadings that act on the diaphragms 12 or 13 can lead to damage to the diaphragms 12 or 13, in particular in the ring area 16, thereby allowing the fluid 10 to be pumped to mix with the working medium 19, resulting in damage to and frequently even blockage of the pumping line 23 and 39, the pressure spaces 21 or 22 and the pumping space 20, therefore the structure of the diaphragms 12 and 13 should be permanently or at least intermittently checked before and during operation of the pumping device 1. This is achieved in that the pumping space 20 and the pumping lines 23 and 39 that emerge into the pumping space 20 are spatially separated from the pressure spaces 21 and 22. This is because a control space 31 is arranged in the housing in between them and is separated from the diaphragms 12 and 13 in the direction of the particular pumping space 20. A control line 32 emerges into the control space 31, by means of which the control space 31 can be evacuated to the atmosphere.

The piston rod 5 penetrates the control space 31, therefore it is necessary to seal the transition area between the piston rod 5 and the housing section 3 to make it air-tight. A bellows 6 is provided for this purpose, the first free end of which is firmly fixed onto the housing section 3 and its second free end onto the piston rod 5. The axial movements of the piston rod 5 are synchronously compensated by the bellows 6.

The control line 32 is connected to a measuring instrument 33 that is electrically connected to the changeover valve 18 via a control cable 34. Furthermore, the measuring instrument 33 has a suction device 37 assigned to it, by means of which the control space 31 can be evacuated via the control line 32, with the result that a negative pressure is established in the control space 31, the pressure level of which is lower than the pressure level prevailing in the particular pumping spaces 20 during the suction and pumping process. A safety valve 35 is integrated in the control line 32 between where it emerges into the control space 31 and the measuring instrument 33, the task of this safety valve 35 being to open the control line 32 if a preset pressure limit value is exceeded, so as to allow any fluid 10 that has penetrated the control space 31 to exit from it.

The safety valve 35 closes the control space 31 during the standstill time of the suction device 37, by means of which the negative pressure level prevailing in the control space 31 does not escape. The safety valve 35 opens as soon as the pumping device 1 is restarted and the suction device 37 has achieved a predetermined negative pressure. This means the control space 31 does not have to be completely evacuated every time the pumping device 1 is started. Instead, the sealing status of the diaphragms 12 and 13 can be monitored immediately after the pumping device 37 has been switched on.

Negative pressure prevails in the control space 31, by means of which the flexible ring area 16 of the diaphragms 12 and 13 is sucked in the direction of the control space 31, with the effect that the ring area 16 is configured as a curved profile 38 aligned in the direction of the control space 31. The prevailing negative pressure within the control space 31 consequently sucks the curved profile of the flexible ring area 16 of the diaphragms 12 or 13 into the control space 31, with the effect that flexible diaphragm 12 and 13 is prevented from folding over in the direction of the particular pumping space 20.

The negative pressure status in the control space 31 can be permanently adapted to the pressure statuses prevailing in the pumping spaces 20 by means of the measuring instrument 33 and the suction device 37 that interacts with it.

Figure 3:
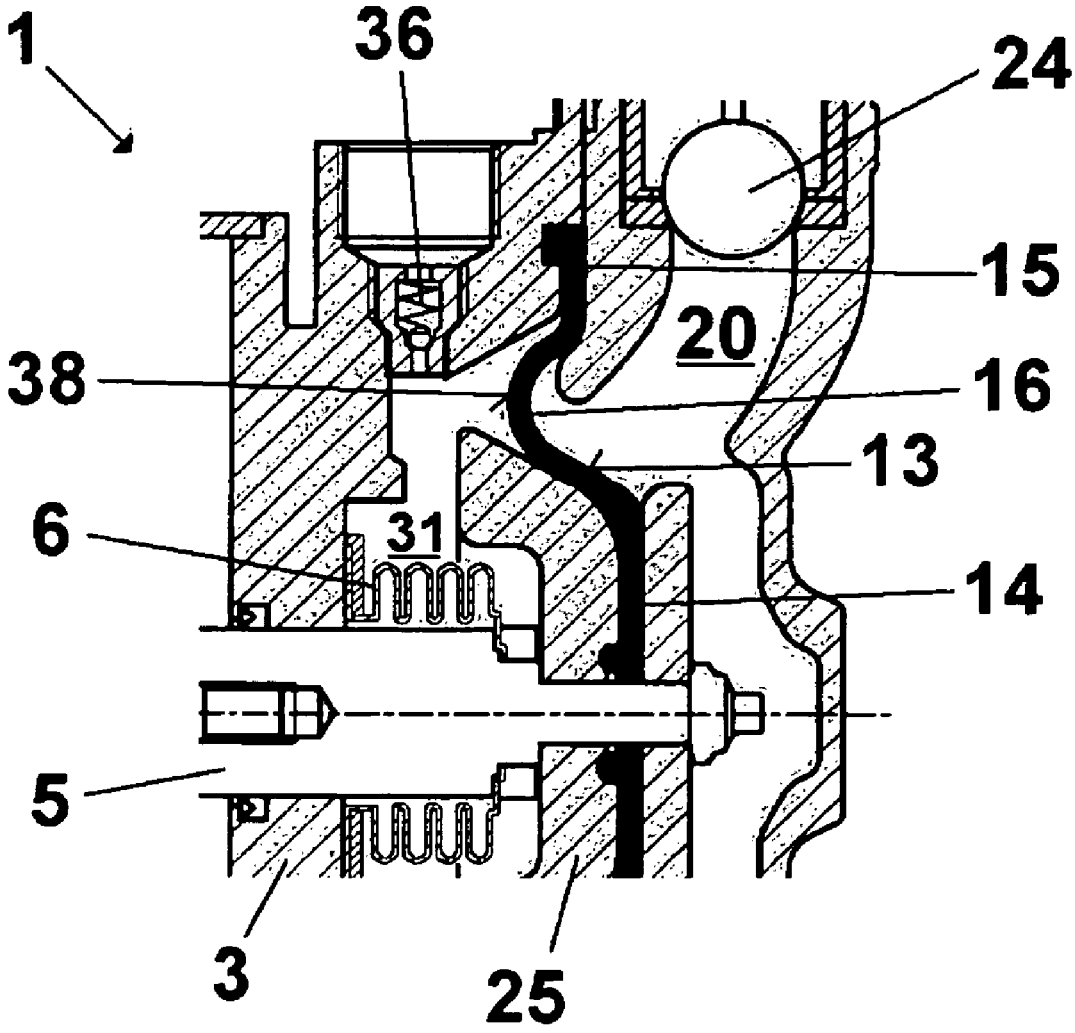
FIG. 3 shows the pumping device in accordance with FIG. 1 in a magnified section.

Furthermore, a pressure relief valve 36 emerges into the control space 31. This can be seen in FIG. 3 in particular. Therefore, if a positive pressure is established in the control space 31, it can escape to the atmosphere through the pressure relief valve 36.

If the diaphragm 12 or 13 has hairline cracks or other damage, in particular in the transitional area between the housing 2 or the two reciprocating pistons 25 that clamp the central area 14 of the diaphragm 12 or 13, air or fluid 10 flows into the control space 31 from the corresponding pumping space 20 through the hairline cracks or damaged points, with the effect that the negative pressure established there rises. This is picked up by the measuring instrument 33. If the negative pressure status prevailing in the control space 31 exceeds a preset limit value, the measuring instrument 33 sends an electrical signal to the changeover valve 18 and to a compressor 18' provided with it, by means of which the working medium 19 is pressed into the pressure line 17 or 17', causing it to be switched off immediately. This means the pumping device 1 is stationary.

The operating personnel can check whether the diaphragm 12 or 13 is damaged. This can also be established with reference to the displays assigned to the measuring instrument 33 that can be read off visually. Thus, before contamination or blending can occur between the fluid 10 and the inner area of the housing 2, it is possible to establish whether the diaphragms 12 and 13 must be renewed on the basis of the operating duration and the associated loadings. This renewal can be performed rapidly and on the spot, with the effect that the downtimes of the pumping device 1 are restricted to a minimum.

What is claimed is:

1. A pumping device (1) by means of which fluids (10) or pourable materials stored in a reservoir tank (9) can be transported to a spray gun (11) in a metered fashion, the device comprising:

a piston rod (5) mounted in an axially moveable arrangement in a housing (2), a reciprocating piston (25) mounted on an end of the housing, a piston (7,8) connected to said piston rod (5) and moveable between first and second housing sections (3,4), by means of which first and second pressure chambers (21, 21', 22, 22') are enclosed by means of said piston (7,8) together with the first and second housing sections (3,4), pressure lines (17, 17') disposed in each of the two housing sections (3,4) such that the pressure lines debouch in one of the pressure chambers (21, 21' or 22, 22'), a working medium (19), by means of which said piston (7,8) can be driven and pressed into the corresponding pressure chamber (21, 21', 22, 22') alternately through said pressure lines (17, 17') by a changeover valve (18), a diaphragm (12, 13) having a central area (14) connected to said piston rod (5) and an outer area (15) connected to the housing (2), and a flexible ring area (16) disposed between said central and outer areas (14, 15), and provided as a compensation and sealing element, and a pumping chamber (20) enclosed by said diaphragm (12, 13) and the housing (2), into which the fluid (10) or pourable material is alternately drawn or from which the fluid (10) or pourable material is pressed in the direction of the spray gun by the axial movement of said reciprocating piston (25), wherein the second housing section and said diaphragm (12, 13) form a control chamber (31) in which a negative pressure prevails, and wherein a negative pressure condition of the control chamber (31) can be monitored from the outside, wherein a control line (32) debouches in the control chamber (31), wherein a line is connected to a measuring device (33) and communicates therewith such that the measuring device (33) allows the negative pressure condition in the control chamber (31) to be measured, and the control chamber (31) is temporarily or permanently connected with a suction device (37) by means of the control line (32), and the suction device (37) allows the control chamber (31) to be evacuated, and said flexible ring area (16) of said diaphragm (12, 13) is drawn into the control chamber (31) due to the negative pressure prevailing in the control chamber (31) and has a curvature (38) projecting in the direction of the control chamber (31).

2. The pumping device in accordance with claim 1, wherein the measuring device (33) is electrically coupled to the changeover valve (18) via a control line (34), and the measuring device (33) allows the changeover valve (18) to be deactivated if a preset negative pressure limit value is exceeded.

3. The pumping device in accordance with claim 2, wherein the measuring device (33) is provided with a display by means of which negative pressure conditions in the control chamber (31) are shown.

4. The pumping device in accordance with claim 1, wherein the suction device (37) is electrically connected to the measuring device (33) and can be controlled by the measuring device.

5. The pumping device in accordance with claim 4, wherein a safety valve (35) is disposed in the control line (32), by means of which the control chamber (31) can be sealed off from the atmosphere in order to maintain the negative pressure condition.

6. The pumping device in accordance with claim 1, wherein one of said diaphragms (12, 13) is disposed at each free end of said piston rod (5).

7. The pumping device, in accordance with claim 1, wherein said pistons (7,8) are attached to said piston rod (5), and are spaced apart from one another.

8. The pumping device in accordance with claim 1, wherein a gaseous or liquid substance is used as said working medium (19) for driving said piston(s) (7,8).

9. The pumping device in accordance with claim 1, wherein a gaseous or liquid substance is disposed in the control chamber (31), the pressure level of which is lower than the pressure level which is established in said pumping chamber (20) during movement of said reciprocating piston (25).

* * * * *